United States Patent [19]

Washington

[11] Patent Number: 4,944,280

[45] Date of Patent: Jul. 31, 1990

[54] SEPARATED CIRCUIT HOT SPARK PRODUCING APPARATUS

[76] Inventor: Carroll M. Washington, 3900 E. Chatham Dr., Richmond, Va. 23222

[21] Appl. No.: 372,602

[22] Filed: Jun. 28, 1989

[51] Int. Cl.[5] ..... F02P 15/00

[52] U.S. Cl. ..... 123/627; 123/169 EA; 123/169 G; 313/146; 313/147

[58] Field of Search ..... 123/627, 620, 169 EA, 123/169 MG, 169 G, 169 EC, 625; 313/123, 124, 125, 126, 146, 147

[56] References Cited

U.S. PATENT DOCUMENTS

| | | | |
|---|---|---|---|
| 1,316,560 | 9/1919 | Conrad | 123/627 |
| 1,341,362 | 5/1920 | Ranney et al. | 123/169 EA |
| 1,406,858 | 2/1922 | Henricks | 123/627 |
| 1,413,140 | 4/1922 | Sutherlin | 123/169 G |
| 1,623,982 | 4/1927 | Smith | 123/627 |
| 1,962,949 | 6/1934 | Claybrook | 123/627 |
| 2,684,451 | 7/1954 | Castongay | 313/146 |
| 2,965,779 | 12/1960 | Zalesak | 313/124 |
| 3,043,980 | 7/1962 | Zalesak | 313/124 |
| 3,244,924 | 4/1966 | Berg et al. | 313/146 |
| 4,046,127 | 9/1977 | Almquist et al. | 123/169 EA |

*Primary Examiner*—Andrew M. Dolinar

*Attorney, Agent, or Firm*—Richard C. Litman

[57] ABSTRACT

A spark gap producing apparatus that introduces an auxiliary gap in the electrical path between the spark source and the spark plug of an internal combustion engine is disclosed. The spark apparatus can be permanently installed such that it maintains a reliable auxiliary gap. Alternatively, it may be installed in a motorized form such that it can be computer controlled. the computer would control the gap size and, therefore, the capacitance of the spark gap apparatus. Thus, depending on the efficiency needs of the engine, the computer would compensate. In still another embodiment, the driver himself would have direct manual control over the gap size. Since spark "hotness" is controlled by the gap size, the driver would have complete control over the efficiency and power of the engine.

20 Claims, 2 Drawing Sheets

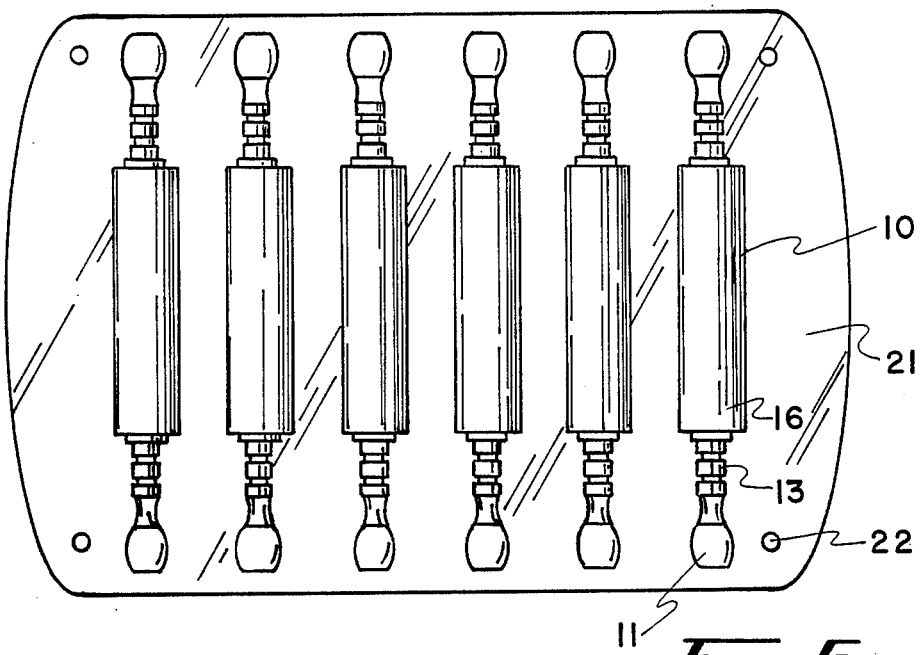
Fig. 5
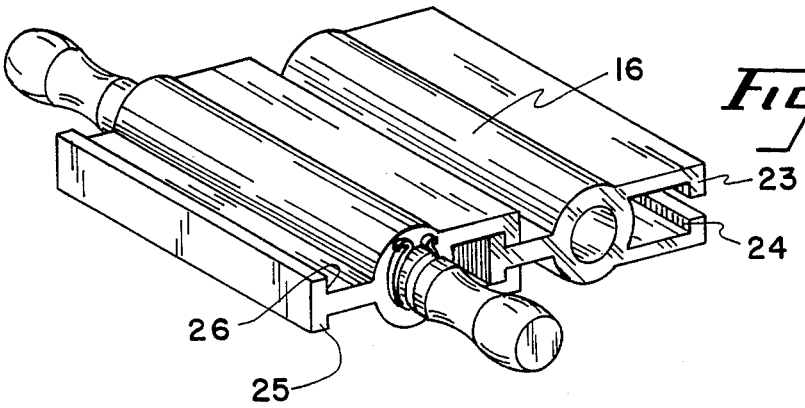
Fig. 6
Fig. 7
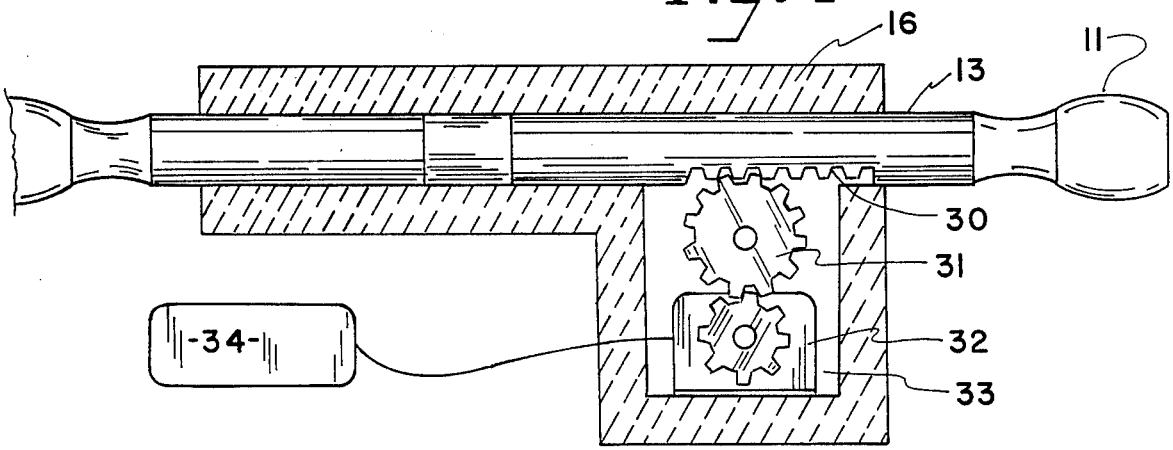

SEPARATED CIRCUIT HOT SPARK PRODUCING APPARATUS

BACKGROUND OF THE INVENTION

1. Field of the Invention

The present invention relates to devices that function to increase the efficiency of the fuel burned within an internal combustion engine. Specifically, the present invention is a device that is designed to introduce an electrical gap in the path from the distributor cap to the spark plug. This gap is air filled. It is surrounded on either side by two planar conductive surfaces. Effectively, the gap in the wires leading to the spark plug operates as a capacitor. As a result, the gap functions to increase the overall voltage applied to the spark plug. The increased spark applied to the spark plug increases the magnitude of the voltage of the spark within the combustion chamber. Thus, the spark plug produces a hotter spark that causes the fuel in the cylinder to burn more completely and efficiently.

2. Description of the Prior Art

The prior art in this area is very well defined. Many inventors have developed means to introduce a variable gap in the electrical path between the spark source and the spark plug. The following references are described in relation to the present invention. A discussion follows to point out the differences that exist between the prior art and the present invention.

U.S. Pat. No. 968,950 issued to E. P. Jahn on Aug. 30, 1910 discloses an apparatus that introduces a gap between the spark source and the spark plug. The device connects directly to the spark plug of an internal combustion engine. The apparatus is essentially a hollow cylindrical structure to which are connected the electrical leads. Metallic pins extend from the electrical connections to the interior of the gap apparatus. The spark is intended to jump from one pin to the other once a sufficient charge has developed. The Jahn apparatus is designed to improve the functioning of an internal combustion engine.

U.S. Pat. No. 1,164,082 issued to J. E. Gallant on Dec. 14, 1915 discloses a spark plug with an auxiliary air gap built into its structure in order to increase the efficiency of an internal combustion engine. The gap size is controlled by a threaded member. Thus, Gallant teaches that there are an infinite number of possible gap sizes that can be recognized in order to increase the burn efficiency of the internal combustion engine.

U.S. Pat. No. 1,169,744 issued to A. F. Gillet on Jan. 25, 1916 discloses an apparatus which is engineered to produce an auxiliary air gap along the electrical path from the spark source to the spark plug. The size of the air gap of the Gillet apparatus is threadedly controlled. Two screws penetrate a cylindrical chamber. Their pointed ends are disposed adjacent at one another without touching. The spark is intended to jump from one screw point to the other. The Gillet apparatus incorporates a means of attachment to a spark plug wherein the angle between the apparatus and the spark plug can be controlled.

U.S. Pat. No. 1,240,721 issued to F. F. Hultgreen on Sept. 18, 1917 discloses an apparatus similar to that of Gillet. However, the attachment of the apparatus to the spark plug differs from that taught by Gillet. The intended result is the same, however.

U.S. Pat. No. 1,406,858 issued to G. W. Herricks on Feb. 14, 1922 discloses a spark gap apparatus of a different nature than those previously mentioned. In the Herricks apparatus, the contacts forming the gap are differently shaped than the prior art of the day. Here, Herricks incorporates both a point contact and a dish shaped contact to increase the efficiency of spark propagation. Moreover, the chamber in which the electrodes are located is a partial vacuum. The vacuum reduces the oxidation and degradation of the electrodes during use.

U.S. Pat. No. 2,185,938 issued to G. D. Crawford on Jan. 2, 1940 discloses a simplified method of incorporating an electrical gap between the spark source and the spark plug of an internal combustion engine. The apparatus is simply a piece of material which separates the contact which is normally attached to the spark plug and the spark plug itself. Thus, the Crawford patent is a very simple modification of the aforementioned prior art.

The present invention offers a novel approach to this problem as well. The present invention is a ceramic housing into which have been placed two metallic leads. The leads or electrodes are separated by a gap filled with air. The present invention can be placed at any point along the electrical path between the spark source and the spark plug. Normally, this will mean that the apparatus will be placed at some point along the path from the distributor cap to the spark plug.

The present invention, therefore, offers a versatility that the prior art does not disclose. It can be attached at any point along the electrical path. This is particularly important in the area of car manufacture. The spark gap apparatuses of the present invention could be centrally located at an easily accessible area within the engine compartment of a car or the like. Thus, when the owner would need to change the spark gap apparatuses, they could all be found in the same location and could be easily replaced.

A second feature of the present invention of particular distinction is the addition of a finite adjustment means to the spark gap apparatus. The concept of a finite adjustment is fairly easy to comprehend. Instead of having an infinite number of possibilities for gap size, as in the Gallant '082 design for example, there are only a finite number in the present invention. The present invention, therefore, offers a reproducible reliability that the prior art does not recognize. The finite number of gap sizes make it possible for the manufacturer of cars to recommend a particular gap size in the car's specification. Thus, each car owner who chooses to utilize the present invention need not experiment until he finds the appropriate gap size. The manufacturer of the car or perhaps the gap apparatus itself can recommend the optimum gap setting.

The present invention offers a third advantage over the prior art. The gap apparatuses can be assembled into a group or gap manifold. The gap manifold can then be installed as a unit in the automobile. Should the owner of the auto wish to replace the old gap apparatuses, he need not find each one individually and replace them as such. The owner need only replace the whole gap manifold as a unit. As a result, time and effort are both saved.

In an alternate embodiment of the present invention, it is foreseen that a computer could be connected to the spark gap apparatus to control the size of the gap. Thus, the computer would regulate the operation of the car automatically. Since control over the gap size does relate to the efficiency and power of the vehicle, the computer would optimize the operation of the engine.

The driver may alternately be provided with a control panel on his dash to regulate the gap size manually. In this way, the driver would have complete control over the operation of his vehicle.

SUMMARY OF THE INVENTION

Accordingly, it is an object of the present invention to provide an apparatus that can introduce an auxiliary gap between the source of the spark and the spark plug of an internal combustion engine.

It is yet another object of the present invention to provide a gap in the electrical path between the spark source and the spark plug of an internal combustion engine to increase the voltage of the corresponding spark of the spark plug which it is attached. The increase of the voltage of the spark within the cylinder of the engine will increase the efficiency of the fuel burn, thereby increasing the efficiency of the engine itself.

It is still another object of the present invention to provide a spark gap producing apparatus that is finitely variable. Such a design provides the owner of such a device reliable reproducibility and reduces the amount of guesswork associated with the installation of the equipment in his engine.

It is another object of the present invention to provide a spark gap producing apparatus for an internal combustion engine that can be installed at any point along the electrical path between the spark source and the spark plug.

It is yet another object of the present invention to provide a spark gap apparatus for an internal combustion engine that can be assembled in combination with others of the same into a gap manifold that can be fixedly installed within the engine compartment of a car or the like.

It is still another object of the present invention to provide a spark gap apparatus for an internal combustion engine that can be installed quickly and readily without the need for tools.

It is an object of the present invention to provide a spark gap apparatus for a combustion engine that is composed of relatively few components.

It is still another object of the present invention to provide a spark gap apparatus for an internal combustion engine that contains parts which may be easily replaced should one of them fail during the lifetime of the apparatus.

It is yet another object of the present invention to provide a spark gap apparatus for an internal combustion engine whose gap size can be quickly and easily adjusted to alter the operation of the apparatus.

It is altogether another object of the present invention to provide a spark gap apparatus that incorporates a removable clamping means to fix the gap size once selected.

It is another object of the present invention to provide a spark gap apparatus for a combustion engine that can be manufactured inexpensively.

It is yet another object of the present invention to provide a computer control means for each of the spark gap apparatuses in order to provide for computer control of the operation of the vehicle.

It is still another object of the present invention to provide a control panel within the passenger compartment of the car or the like so that the driver of the vehicle can control the magnitude of the spark introduced to the cylinders of the engine. As a result, the driver has direct control over the efficiency and power of the vehicle.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

FIG. 5 is a top view illustration of a gap manifold or an assemblage of the spark gap producing apparatuses of the present invention.

FIG. 6 is a perspective illustration of two of the apparatuses of the present invention with external attachment tracks attached to allow for connection of one spark gap apparatus to another.

FIG. 7 is a cross-sectional illustration of the remotely controlled embodiment of the present invention.

Similar reference characters designate corresponding parts throughout the various figures of the drawings.

DESCRIPTION OF THE PREFERRED EMBODIMENT

Figure 1:
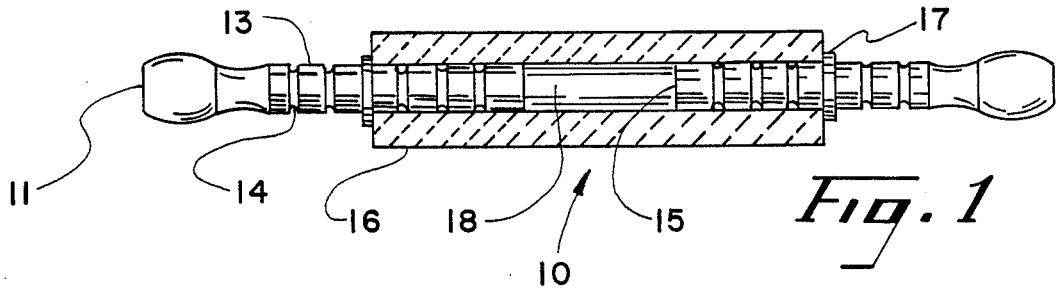
FIG. 1 is a cross-sectional illustration of the present invention.

The spark gap apparatus of the present invention is generally designated 10 throughout the various figures of the drawings. In reference to FIG. 1, the spark gap apparatus 10 can be seen to be composed essentially of three separate components, the non-conducting chamber 16, the electrode shank 13, and the clamp 17. The non-conducting chamber 16 is substantially a cylindrical hollow tube made of a non-conducting material such as ceramic. Each of the ends of the non-conducting chamber 16 has inserted in it an electrode shank 13. A clamp 17 holds the electrode shank 13 in a fixed position. A clamp 17 is also located at each end of the non-conducting chamber 16.

The non-conducting chamber 16 may be composed of any non-conducting material such as ceramic as mentioned. However, it should be noted at this point that any non-conducting material that can withstand the voltage supplied by an internal combustion engine without catastrophic failure is suitable. The electrode shank 13 is to be made of any suitable conducting material such as steel. The preferred conductor for this application is steel because of its excellent qualities as a conductor and its qualities of strength. However, any material which will not decompose rapidly when subjected to a spark arcing onto its surface is acceptable for this application.

The electrode 12 contains several parts which are worthy of mention. First, the most important feature to mention is the series of grooves 14 cut at regular intervals along the electrode shank 13. The grooves 14 serve to provide the appropriate area for the clamp 17 to grip the electrode 12. The electrode 12 is basically cylindrical in shape having two ends. At one end, the electrode 12 has a planar surface 15 which is located within the non-conducting chamber 16. The other end of the electrode 12 is fitted with an electrode head 11. The electrode head 11 is provided so that a wire may be easily attached thereto.

When the electrodes 12 are inserted into the non-conducting chamber 16, they leave a space between their respective end surfaces 15 called an air gap 18. This air gap 18, as the name suggests is filled with air. It is through the medium of air that the spark will travel when introduced to one side of the spark gap apparatus 10.

Effectively, the spark gap apparatus 10 functions in the same fashion as a capacitor. The air in the air gap 18 acts as the dielectric between the capacitor plates or the electrode end surfaces 15. When a current is applied to one end of the spark gap apparatus 10, a charge builds until it gains sufficient magnitude to arc across the gap 18 distance to the electrode 12 on the opposite side. The charge necessary to force a spark to jump the gap 18 is dependent upon the capacitance of the apparatus 10.

This capacitive operation can be described by the following equation:

$$C=8.84\times10^{12}*A/D$$

where:

C=Capacitance

A=Area of the plates

D=Distance between the plates $8.84\times10^{12}$=The proportionality constant for air in a capacitor The equation for a capacitor, generally is:

$$q=C*v$$

where:

q=The charge on the plates

C=The capacitance v=The voltage

Therefore, the greater the capacitance, the lower the voltage, the "cooler" the spark. As a result, the capacitance would need to be minimized.

From the equations above, it can be seen that as the area of the capacitor plates, or in this case the electrode end surfaces 15, increases, the capacitance also increases. In other words, as the area of the plates gets larger, the charge needed to breach the plates 15 is increased equally. As a result, the electrode surfaces 15 would need be planar in order to have the most minimal area for the application. The smaller the area, the "hotter" the spark generated. The only possible way to minimize the area of the surfaces 15 would be to make sure that they are both planar surfaces 15. In this fashion, the area is minimized and so is the capacitance.

Moreover, by adjusting the air gap 15 size, the capacitance is decreased. This means that the greater the distance between the end surfaces 15, the more charge is required to make the spark jump from one end surface 15 to the other. The greater the charge, the "hotter" the spark. The hotter the spark, the hotter will be the spark from the spark plug. The hotter the spark in the spark plug, the more efficient is the burning of the fuel. As a result, the internal combustion engine runs more efficiently and, therefore, better. Of course, because the voltage applied to the apparatus 10 is of limited magnitude only, there is a maximum distance that the spark will be able to jump. This distance will vary from one make of car to another.

The air gap 18 size can be controlled by a person by adjusting the distance of one electrode 12 from another. The person need only remove the clamp 17 from the groove 14 in which it sits on the electrode shank 13. The clamp 17 is moved to another location, and the electrode 12 is replaced in the non-conducting chamber 16. In this manner, any number of finite distances may be selected to optimize the operation of the engine.

Figure 4:
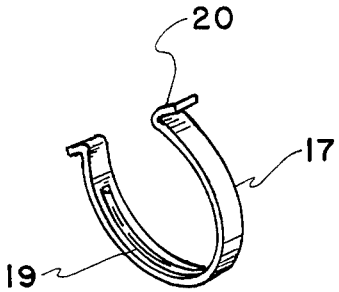
FIG. 4 is an expanded illustration of the clamping means used to fix the electrode in position once the gap size has been selected.

The clamp 17, shown in FIG. 4, is provided with two essential features for its function. First, a clamp extrusion 19 is provided on part of the inner surface of the clamp 17. The extrusion 19 is such that it fits into one of the grooves 14 of the electrode shank 13. In this manner, the clamp 14 can not move along the length of the shank 13. Secondly, the clamp is provided with curled lips 20 at each end. These lips 20 provide the necessary surface area for a person to remove the clamp 17 from its position. The person need only insert his finger in the gap between the lips 20 and spread the lips 20 apart. The clamp 17 is then easily removed. A hook means (not shown) could be attached to the non-conducting chamber 16 to prevent the electrode 12 from sliding out of its position within the chamber 16.

Figure 2:
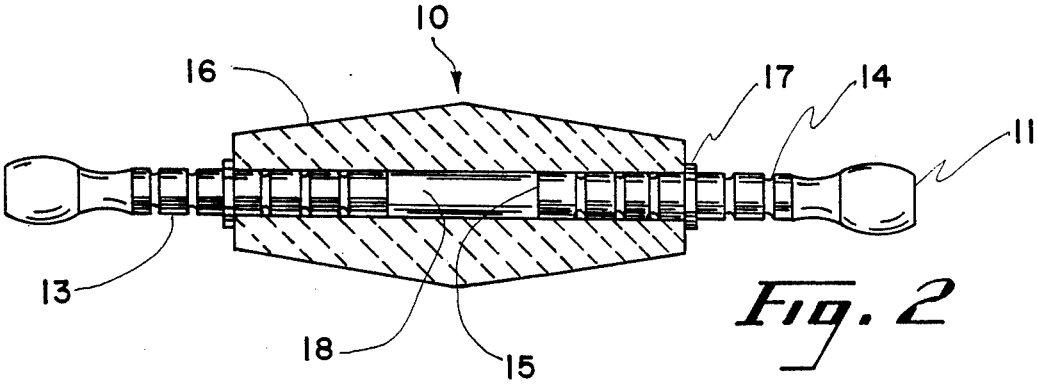
FIG. 2 is a cross-sectional illustration of the present invention in an alternate embodiment.
Figure 3:
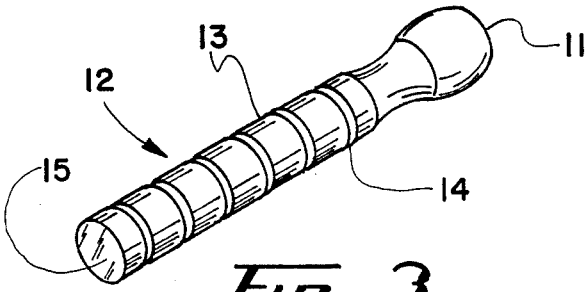
FIG. 3 is a perspective illustration of the grooving detail along the length of one of the electrodes of the present invention.

In an alternate embodiment of the spark gap apparatus 10, the non-conducting chamber 16 could take a different external shape. FIG. 2 is an excellent example of such a change in the basic design. Here, the increase in the thickness of the chamber 16 serves an important function. In an application where the maximum spark "hotness" is desired, the chamber 16 is likely to become very hot, thermally. The additional non-conducting material would serve to prevent catastrophic failure of the spark gap apparatus 10 in this particular circumstance.

The spark gap apparatus 10 may also be affixed to a manifold base plate 21. This embodiment is described pictorially in FIG. 5. In this embodiment, several apparatuses 10 would be attached in a central location. The plate 21 could then be attached to a specific location within the engine compartment by use of the screw holes 22 provided on the plate. Thus, when the owner of the vehicle would need to replace the entire manifold 21, he should simply remove the old and install the new.

The manifold 21 concept can be altered such that individual spark gap devices 10 can be removed and replaced. This embodiment is described pictorially in FIG. 6. Here, the apparatuses 10 are connected to one another by L-shaped 23 and T-shaped protrusions 25 extruding from the exterior surfaces. The T-shaped protrusion 25 from one apparatus 10 would fit between a pair of L-shaped protrusions 23 of another. The L-shaped protrusion 23 has a gripping surface 24 that holds the gripped surface 26 of the T-shaped protrusion 25 in place. In this manner, any number of spark gap apparatuses 10 could be attached in series for any number of applications.

FIG. 7 describes pictorially the two final embodiments of the present invention. In these embodiments, a control panel 34 is added to the spark gap apparatus 10. The control panel 34 is a remote device that controls the gap 18 size. In this embodiment, a minor alteration is made to the spark gap apparatus 10. One of the electrodes 12 is fixed in its location and can not be moved. The other is movable and its distance from the fixed electrode 12 is regulated by the control panel 34.

The movable electrode 12 has on part of its shank 13 a toothed track 30. This toothed track 30 meshes with a gear 31 or set of gears 31 which are driven by an electrical motor 32 located in a motor cavity 33 within the non-conductive chamber 16. The motor 32 may alternately be located outside of the non-conducting chamber 16. In this alternative, the drive shaft of the motor 32 would extend into the non-conducting chamber 16 to move the electrode 12 via the gear 31 located there.

The control panel 34 could take one of two possible forms, thus resulting in the two alternate embodiments aforementioned. The first of these embodiments is where the control panel 34 is actually a computer. The control computer 34 would be connected to the engine such that it could monitor the performance and power of the engine. If the vehicle were not performing to optimum efficiency, the computer 34 would adjust the gap 18 size automatically and return the engine to optimum capacity. In this manner, the computer would constantly adjust the gap 18 size to keep the engine running to its best capability.

The control box 34 could alternatively be located within the passenger compartment of the vehicle. In this case, the driver would have control over the gap 18 size of the spark gap apparatuses 10. Thus, if the driver required more power from the vehicle, he could increase the gap 18 size. If he did not want to have more power, he could return the gap 18 size to normal operating conditions. Thus, the driver would have complete control over the operation of this vehicle in any and all circumstances.

It is to be understood that the present invention is not limited to the sole embodiment described above, but encompasses any and all embodiments within the scope of the following claims.

I claim:

1. An apparatus to introduce an adjustable auxiliary gap in the electrical path between the spark source and spark plug of an internal combustion engine comprising:

a non-conducting cylindrical housing having two ends longitudinally disposed along the length of said non-conducting cylindrical housing, said non-conducting cylindrical housing having an exterior and an interior surface, two electrodes comprised of a conductive material, said electrodes being substantially cylindrical in shape, said electrodes having two ends defining length of said electrode, the first of said ends of said electrode being a planar end surface, the second of said ends of said electrode being substantially spherical in shape allowing for the removable attachment to a spark plug wire, said planar end surface of each of said electrodes being inserted into the interior of said non-conducting cylindrical housing, said planar end surfaces of each of said electrodes being displaced next to one another without contacting one another within said interior of said non-conducting cylindrical housing, said electrodes having adjustment means, said adjustment means being grooves, and said grooves being displaced at regular intervals along the length of said electrodes.

2. An apparatus to introduce an adjustable auxiliary gap in the electrical path between the spark source and spark plug of an internal combustion engine comprising according to claim 1, further comprising:

a removable clamp means, said removable clamp means being substantially cylindrical in shape, said removable clamp means having an extrusion attached to its interior surface for engagement with said grooves displaced along the length of said electrode shaft, and said electrodes being surrounded in part at one point along the length of said electrode by said removable clamp means.

3. An apparatus to introduce an adjustable auxiliary gap in the electrical path between the spark source and spark plug of an internal combustion engine according to claim 1, wherein:

said non-conducting cylindrical housing having a greater thickness at the midpoint between said ends.

4. An apparatus to introduce an adjustable auxiliary gap in the electrical path between the spark source and spark plug of an internal combustion engine according to claim 1, further comprising:

a motor located within a motor cavity between said interior surface and said exterior surface of said non-conducting cylindrical housing, said motor having a drive shaft, said drive shaft having a gear means thereattached, said grooves on said electrode being a toothed track, said gear means engaging said electrode having said toothed track displaced thereon, and said motor having motor control means.

5. An apparatus to introduce an adjustable auxiliary gap in the electrical path between the spark source and the spark plug of an internal combustion engine according to claim 1, further including:

a motor located exteriorly in relation to said non-conducting cylindrical housing, said motor having a drive shaft, said drive shaft having a gear means thereattached, said gear means being placed within a cavity disposed between said interior surface and said exterior surface of said non-conducting cylindrical housing, said grooves on said electrode being a toothed track, said gear means engaging said electrode having said toothed track displaced thereon, and said motor having motor control means.

6. An apparatus to introduce an adjustable auxiliary gap in the electrical path between the spark source and spark plug of an internal combustion engine according to claim 4, wherein:

said motor control means being manually controlled by a person.

7. An apparatus to introduce an adjustable auxiliary gap in the electrical path between the spark source and spark plug of an internal combustion engine according to claim 5, wherein:

said motor control means being manually controlled by a person.

8. An apparatus to introduce an adjustable auxiliary gap in the electrical path between the spark source and spark plug of an internal combustion engine according to claim 4, wherein:

said motor control means being a computer having the ability to automatically control the position of said electrode within said non-conducting cylindrical housing.

9. An apparatus to introduce an adjustable auxiliary gap in the electrical path between the spark source and spark plug of an internal combustion engine according to claim 5, wherein:

said motor control means being a computer having the ability to automatically control the position of said electrode within said non-conducting cylindrical housing.

10. An apparatus to introduce an adjustable auxiliary gap in the electrical path between the spark source and spark plug of an internal combustion engine according to claim 1, wherein:

a plurality of said non-conducting cylindrical housings being attached to a base plate, and said base plate including one or more holes allowing attachment of said base plate to a substrate material.

11. An apparatus to introduce an adjustable auxiliary gap in the electrical path between the spark source and spark plug of an internal combustion engine according to claim 1, further comprising:

said non-conducting cylindrical housings having a gripping track, said non-conducting cylindrical housings having a gripped track, and said gripping track and said gripped track attaching to said exterior surface of said non-conducting cylindrical housing.

12. An apparatus to introduce an adjustable auxiliary gap in the electrical path between the spark source and spark plug of an internal combustion engine according to claim 11, wherein:

said gripping track being a pair of laterally disposed L-shaped members, said gripped track being a T-shaped member, and said T-shaped member removably engagable with said pair of said L-shaped members.

13. An apparatus to introduce an adjustable auxiliary gap in the electrical path between the spark source and spark plug of an internal combustion engine comprising:

a non-conducting cylindrical housing having two ends longitudinally disposed along the length of said non-conducting cylindrical housing, said non-conducting cylindrical housing having an exterior and an interior surface, said non-conducting cylindrical housing having attachment means attached to said exterior surface allowing for attachment of one of said non-conducting cylindrical housings to another, two electrodes comprised of a conductive material, said electrodes being substantially cylindrical in shape, said electrodes having two ends defining length of said electrode, the first of said ends of said electrode being a planar end surface, the second of said ends of said electrode being substantially spherical in shape allowing for the removable attachment to a spark plug wire, said planar end surfaces of each of said electrodes being inserted into the interior of said non-conducting cylindrical housing, said planar end surfaces of each of said electrodes being displaced next to one another without contacting one another within said interior of said non-conducting cylindrical housing, said electrodes having adjustment means, said adjustment means having control means there attached, said adjustment means being grooves, and said grooves being displaced at regular intervals along the length of said electrodes.

14. An apparatus to introduce an adjustable auxiliary gap in the electrical path between the spark source and spark plug of an internal combustion engine according to claim 13, wherein:

said non-conducting cylindrical housing having a greater thickness at the midpoint between said ends.

15. An apparatus to introduce an adjustable auxiliary gap in the electrical path between the spark source and spark plug of an internal combustion engine according claim 13, further comprising:

a motor located within a motor cavity between said interior surface and said exterior surface of said non-conducting cylindrical housing, said motor having a drive shaft, said drive shaft having a gear means thereattached, said grooves on said electrode being a toothed track, said gear means engaging said electrode having said toothed track displaced thereon, said motor having motor control means, and said motor being said adjustment means.

16. An apparatus to introduce an adjustable auxiliary gap in the electrical path between the spark source and the spark plug of an internal combustion engine according to claim 13, further including:

said motor having a drive shaft, said drive shaft having a gear means thereattached, said gear means being placed within a cavity disposed between said interior surface and said exterior surface of said non-conducting cylindrical housing, said grooves on said electrode being a toothed track, said gear means engaging said electrode having said toothed track displaced thereon, and said motor having motor control means.

17. An apparatus to introduce an adjustable auxiliary gap in the electrical path between the spark source and spark plug of an internal combustion engine according to claim 15, wherein:

said motor control means being a computer having the ability to automatically control the position of said electrode within said non-conducting cylindrical housing.

18. An apparatus to introduce an adjustable auxiliary gap in the electrical path between the spark source and spark plug of an internal combustion engine according to claim 16, wherein:

said motor control means being a computer having the ability to automatically control the position of said electrode within said non-conducting cylindrical housing.

19. An apparatus to introduce an adjustable auxiliary gap in the electrical path between the spark source and spark plug of an internal combustion engine according to claim 13, wherein:

said attachment means being a gripping track and a gripped track, and said gripping track and said gripped track attaching to said exterior surface of said non-conducting cylindrical housing.

20. An apparatus to introduce an adjustable auxiliary gap in the electrical path between the spark source and spark plug of an internal combustion engine according to claim 19, wherein:

said gripping track being a pair of laterally disposed L-shaped members, said gripped track being a T-shaped member, and said T-shaped member removably engagable with said pair of said L-shaped members.

* * * * *